US012228291B2

(12) United States Patent
Cowan

(10) Patent No.: US 12,228,291 B2
(45) **Date of Patent: *Feb. 18, 2025**

(54) COOKING APPLIANCE WITH SELF-CLOSING USER CONTROL

(71) Applicant: Midea Group Co., Ltd., Foshan (CN)

(72) Inventor: Richard W. Cowan, Buford, GA (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/428,854

(22) Filed: Jan. 31, 2024

(65) Prior Publication Data

US 2024/0167686 A1 May 23, 2024

Related U.S. Application Data

(63) Continuation of application No. 17/567,566, filed on Jan. 3, 2022, now Pat. No. 11,933,502.

(51) Int. Cl.
*F24C 3/12* (2006.01)
*F24C 3/10* (2006.01)

(52) U.S. Cl.
CPC ..... *F24C 3/124* (2013.01); *F24C 3/103* (2013.01)

(58) Field of Classification Search
CPC ..... H01H 3/0206; F24C 3/103; F24C 3/124
USPC ..... 126/413; 431/256
See application file for complete search history.

(56) References Cited

U.S. PATENT DOCUMENTS

| | | | | |
|---|---|---|---|---|
| 2,596,505 | A | 5/1952 | Pacifico | |
| 3,411,375 | A | 11/1968 | Medicks | |
| 4,890,006 | A | 12/1989 | Huang | |
| 6,375,150 | B1 | 4/2002 | Aguirre-Esponda | |
| 6,394,081 | B1 | 5/2002 | Aguirre-Esponda | |
| 8,168,907 | B2 | 5/2012 | Nemetz | |
| 8,997,591 | B1 | 4/2015 | Vircks | |
| 10,753,619 | B2 | 8/2020 | Yang | |
| 11,933,502 | B2 * | 3/2024 | Cowan | F24C 3/126 |
| 2015/0168987 | A1 | 6/2015 | O'Keefe | |
| 2020/0056789 | A1 | 2/2020 | Oberndorfer | |
| 2023/0213199 | A1 | 7/2023 | Cowan | |

FOREIGN PATENT DOCUMENTS

| | | | |
|---|---|---|---|
| DE | 102009037856 | A1 | 2/2011 |
| EP | 1892602 | A1 | 2/2008 |
| EP | 2802956 | B1 | 11/2014 |

OTHER PUBLICATIONS

Avia Dynamics, Rotary Switch, R2 Rotary Switch, Retrieved from: http://www.aviadynamics.com/wp-content/uploads/R2.pdf, Jun. 2009.
ABB, M3SSC7-10B Modular Selector Switch, Retrieved from:https://new.abb.com/products/1SFA611256R1006/m3ssc7-10b, Retrieved on Jun. 14, 2021.

* cited by examiner

*Primary Examiner* — Vivek K Shirsat
(74) *Attorney, Agent, or Firm* — Gray Ice Higdon

(57) ABSTRACT

A cooking appliance includes a self-closing user control for a cooking element that is capable of automatically returning to an off position whenever it is released by a user in a portion of the movable range of positions for the self-closing user control, yet also is capable of maintaining its position in another portion of the movable range of positions for the self-closing user control.

18 Claims, 12 Drawing Sheets

COOKING APPLIANCE WITH SELF-CLOSING USER CONTROL

BACKGROUND

Cooking appliances such as cooktops, ovens and ranges may be powered by various types of cooking elements, with electrical heating elements and gas burners being among the most common. In particular, gas burners generally use as an energy source a combustible gas such as natural gas or liquified petroleum (LP) gas (also referred to as propane), and generate heat by combusting and burning the gas. The output levels of gas burners are generally controlled by valves, which regulate gas flow to the gas burners, and which in some instances are coupled mechanically to associated user controls, e.g., knobs that are rotatable by a user to control gas flow rates through the valves. Gas burners also generally require some manner of igniting the burners, and many gas cooktop burners utilize spark igniters that are also activated based upon the positions of the associated user controls for the gas burners.

One risk associated with conventional burners is associated with unintentional movement of the associated user controls from off positions, e.g., as a result of being bumped into by humans or pets, or being played with by children. In some instances, for example, unintentional rotation of a knob may open a gas valve to an extent that uncombusted gas flows into a room through the gas burner. In other instances, the unintentional rotation may be sufficient to also activate an igniter and cause the gas burner to ignite. In addition, even with electrical cooking elements, unintentional rotation of a knob may cause a cooking element to activate, resulting in a hot surface that may not be readily apparent to those in the vicinity of the cooking appliance. Conventional approaches to reducing the incidents of unintentional knob rotation mainly focus on requiring some two-step activation sequence, e.g., requiring a knob to be pushed in before turning to an active position. Nonetheless, it is still possible in some circumstances for a knob to be hit in such a manner that the knob is both pushed in and turned, resulting in an unintentional activation of the burner or cooking element.

Therefore, a need continues to exist in the art for a manner of reducing incidents of unintentional activation of a cooking element.

SUMMARY

The herein-described embodiments address these and other problems associated with the art by providing a cooking appliance and self-closing user control therefor that is capable of automatically returning to an off position whenever it is released by a user in a portion of the movable range of positions for the self-closing user control, yet also is capable of maintaining its position in another portion of the movable range of positions for the self-closing user control.

Therefore, consistent with one aspect of the invention, a cooking appliance may include a cooking element, and a self-closing user control configured to activate the cooking element and control an output level of the cooking element, where the self-closing user control is movable by a user within a range of positions, and the range of positions includes an off position at which the cooking element is inactive, a biased subrange of positions within which the self-closing user control is biased to the off position such that the self-closing user control automatically returns to the off position when released by the user, and an unbiased subrange of positions within which the self-closing user control is unbiased such that the self-closing user control maintains its position when released by the user.

In some embodiments, the cooking element is a gas burner, the cooking appliance includes a gas valve configured to regulate gas flow to the gas burner, and the self-closing user control is mechanically coupled to the gas valve. Also, in some embodiments, the cooking appliance further includes an igniter configured to ignite the gas burner when gas flow is supplied to the gas burner by the gas valve and the self-closing user control is in an ignition subrange of positions.

Further, in some embodiments, the biased subrange of positions at least partially overlaps the ignition subrange of positions. In some embodiments, the ignition subrange of positions is intermediate the off position and the unbiased subrange of positions. In addition, in some embodiments, the unbiased subrange of positions at least partially overlaps an operating subrange of positions.

In some embodiments, the self-closing user control includes a knob that rotates about an axis of rotation, the range of positions corresponds to a range of angular positions about the axis of rotation, the biased subrange of positions corresponds to a biased subrange of angular positions about the axis of rotation and the unbiased subrange of positions corresponds to an unbiased subrange of angular positions about the axis of rotation. In addition, in some embodiments, the biased subrange of angular positions extends at least about 80 degrees from an off angular position corresponding to the off position and the unbiased subrange of angular positions extends at least from about 90 degrees from the off angular position.

In addition, some embodiments may further include a closure mechanism that biases the self-closing user control to the off angular position when the self-closing user control is in the biased subrange of angular positions. In some embodiments, the closure mechanism includes rotatable and fixed closure members, the rotatable closure member being rotatable about the axis of rotation and mechanically coupled to the knob for rotation therewith, and the fixed closure member being non-rotatable about the axis of rotation, a spring coupled between the rotatable and fixed closure members and configured to be loaded in response to rotation of the knob away from the off position, and a transfer mechanism coupled to the spring and configured to transfer the load of the spring from the rotatable closure member to the fixed closure member when the self-closing user control transitions from the biased subrange of angular positions to the unbiased subrange of angular positions.

Moreover, in some embodiments, each of the rotatable and fixed closure members includes a pin recess, the spring includes a torsion spring having first and second legs extending generally radially from the axis of rotation, the first leg of the torsion spring is coupled to one of the rotatable and fixed closure members, and the transfer mechanism includes a pin coupled to the second leg of the torsion spring and configured to engage the pin recess of the rotatable closure member when the self-closing user control is in the biased subrange of angular positions and to engage the pin recess of the fixed closure member when the self-closing user control is in the unbiased subrange of angular positions. In some embodiments, the second leg of the torsion spring defines a second axis of rotation, the pin is rotatable about the second axis of rotation, the pin includes first and second radial members extending generally radially from the second axis of rotation and angularly offset from one another about the second axis of rotation, the first radial member is configured to engage the pin recess of the rotatable closure member when the self-closing user control is in the biased subrange of angular positions, the second radial member is configured to engage the pin recess of the fixed closure member when the self-closing user control is in the unbiased subrange of angular positions, and the pin is configured to rotate about the second axis of rotation to disengage the first radial member from the pin recess of the rotatable closure member and engage the second radial member with the pin recess of the fixed closure member when the self-closing user control transitions from the biased subrange of angular positions to the unbiased subrange of angular positions. In addition, in some embodiments, the first and second radial members extend generally perpendicularly from the second axis of rotation and are angularly offset from one another by about 90 degrees, the rotatable and fixed closure members are separated from one another by an annular track, the second radial member is positioned within the track when the first radial member engages the pin recess of the rotatable closure member, and the first radial member is positioned within the track when the second radial member engages the pin recess of the fixed closure member.

In some embodiments, at least a portion of the closure mechanism is integrated into one of a control actuator, a gas valve, a bezel or a switch. Moreover, in some embodiments, the closure mechanism includes rotatable and fixed closure members, the rotatable closure member being rotatable about the axis of rotation and mechanically coupled to the knob for rotation therewith, and the fixed closure member being non-rotatable about the axis of rotation, a first track disposed in one of the rotatable and fixed closure members, a second track disposed in the other of the rotatable and fixed closure members and facing the first track, and a spring-loaded cam follower configured to concurrently engage each of the first and second tracks, where the first track includes a substantially radial portion and a substantially annular portion, the spring-loaded cam follower engages the substantially radial portion of the first track when the self-closing user control is in the biased subrange of angular positions, and the spring-loaded cam follower engages the substantially annular portion of the first track when the self-closing user control is in the unbiased subrange of angular positions.

Also, in some embodiments, the closure mechanism includes a cam being rotatable about the axis of rotation and mechanically coupled to the knob for rotation therewith, the cam including a substantially radial portion and a substantially annular portion, and a spring-loaded cam follower configured to engage the substantially radial portion of the cam when the self-closing user control is in the biased subrange of angular positions, and to engage the substantially annular portion of the cam when the self-closing user control is in the unbiased subrange of angular positions. In some embodiments, the closure mechanism includes a clutch assembly including first and second opposing clutch members configured for relative rotation therebetween about the axis of rotation, one of the first and second clutch members being rotatable about the axis of rotation and mechanically coupled to the knob for rotation therewith. In addition, in some embodiments, the self-closing user control further includes a damping mechanism configured to dampen return of the self-closing user control to the off position when released by the user.

Consistent with another aspect of the invention, a self-closing user control for activating and controlling an output level of a cooking element of a cooking appliance may include a base, and a control actuator mounted to the base and movable by a user within a range of positions, where the range of positions includes an off position at which the cooking element is inactive, a biased subrange of positions within which the self-closing user control is biased to the off position such that the control actuator automatically returns to the off position when released by the user, and an unbiased subrange of positions within which the control actuator is unbiased such that the control actuator maintains its position when released by the user.

Consistent with another aspect of the invention, a cooking appliance may include a gas burner, a gas valve configured to supply gas to the gas burner, and a self-closing user control mechanically coupled to the gas valve and configured to control a rate of gas flow through the gas valve, where the self-closing user control includes a knob that is rotatable about a first axis of rotation by a user from within a range of angular positions that includes an off position at which the cooking element is inactive, rotatable and fixed closure members, the rotatable closure member being rotatable about the first axis of rotation and mechanically coupled to the knob for rotation therewith, the fixed closure member being non-rotatable about the first axis of rotation, and each of the rotatable and fixed closure members including a pin recess, a torsion spring coupled between the rotatable and fixed closure members and configured to be loaded in response to rotation of the knob away from the off position, the torsion spring having first and second legs extending generally radially from the axis of rotation, the first leg of the torsion spring coupled to one of the rotatable and fixed closure members, and the second leg defining a second axis of rotation, and a pin coupled to the second leg of the torsion spring and rotatable about the second axis of rotation, the pin including first and second radial members extending generally radially from the second axis of rotation and angularly offset from one another about the second axis of rotation, the first radial member configured to engage the pin recess of the rotatable closure member when the knob is in a first subrange of angular positions, the second radial member configured to engage the pin recess of the fixed closure member when the knob is in a second subrange of angular positions, and the pin configured to rotate about the second axis of rotation to disengage the first radial member from the pin recess of the rotatable closure member and engage the second radial member with the pin recess of the fixed closure member when the knob transitions from the first subrange of angular positions to the second subrange of angular positions.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

FIGS. 7A-10A are exploded front perspective views, and FIGS. 7B-10B are front perspective views, of the self-closing user control of FIGS. 6A-6B at successive rotational positions from the off position.

DETAILED DESCRIPTION

In the embodiments discussed hereinafter, a gas cooking appliance may include a self-closing user control for a cooking element that is biased to an off position when in a first range of positions such that the user control automatically returns to an off position when released by a user, and that is unbiased when in a second range of positions such that the user control maintains its position when released by the user, as such, should the user control be unintentionally moved to a position within the first range of positions, the user control will automatically return to the off position rather than remaining in the position to which it has been moved.

Figure 1:
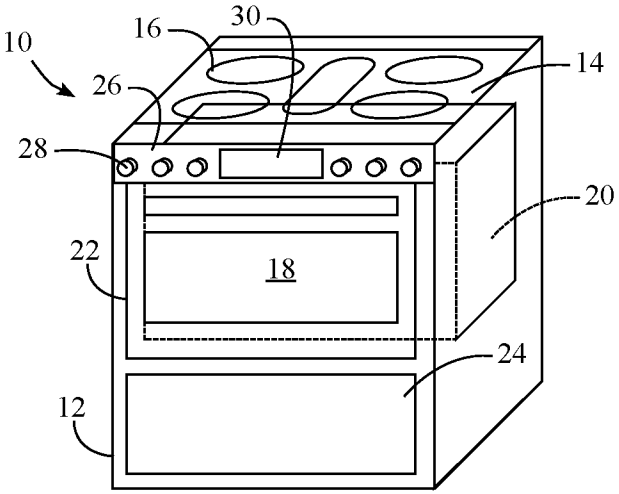
FIG. 1 is a perspective view of a cooking appliance including a self-closing user control consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of cooking elements 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18.

Cooking appliance 10 may also include various user interface devices, including, for example, a control panel 26 incorporating a plurality of rotary burner controls (e.g., a self-closing user control 28) and a user interface or display 30 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 30 may be touch sensitive to receive user input in addition to displaying status information and/or otherwise interacting with a user.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a cooktop, stovetop or hob lacking an integrated oven, a wall-mounted oven lacking an integrated cooktop, or an indoor or outdoor grill. Moreover, the cooking elements may be implemented using various types of cooking technologies, e.g., various combinations of gas, electric, inductive, light, and/or microwave cooking elements, among others.

Numerous variations and modifications to the cooking appliance illustrated in FIG. 1 will be apparent to one of ordinary skill in the art, as will become apparent from the description below. Therefore, the invention is not limited to the specific implementations discussed herein.

Figure 2:
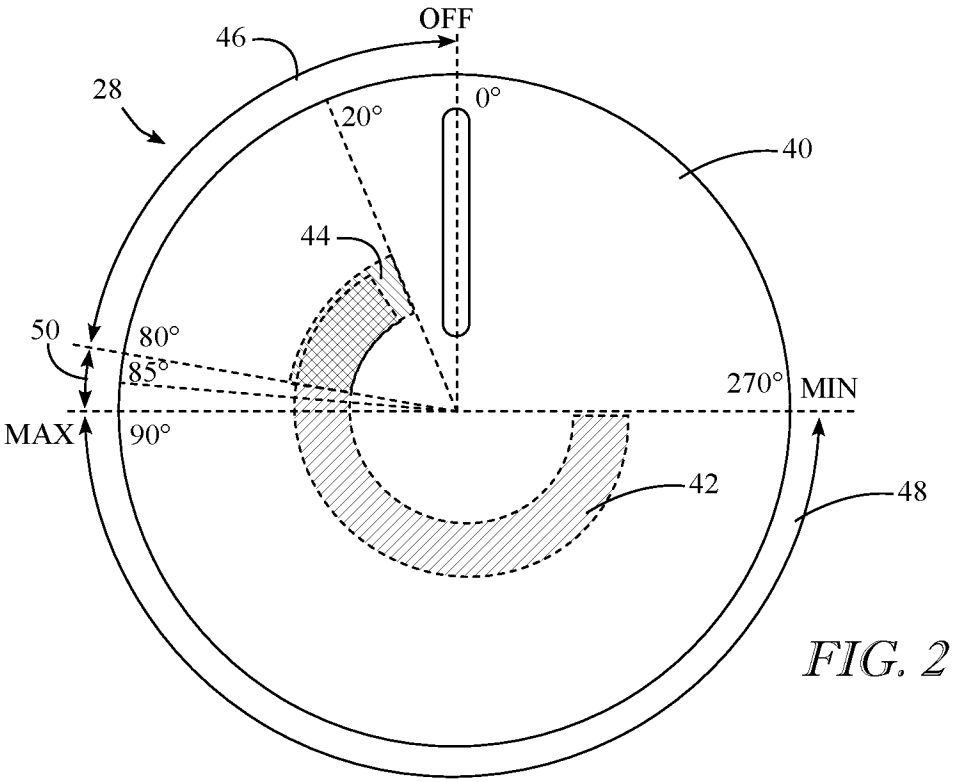
FIG. 2 is a diagram illustrating various positional subranges in the movement of the self-closing user control referenced in FIG. 1.

As noted above, embodiments consistent with the invention may utilize a self-closing user control for a cooking element that is biased to an off position when in a first range of positions such that the user control automatically returns to an off position when released by a user, and that is unbiased when in a second range of positions such that the user control maintains its position when released by the user. FIG. 2, for example, illustrates self-closing user control 28 of FIG. 1, which in the illustrated embodiment is implemented as a rotary user control including a rotary control actuator, e.g., a knob 40. In this implementation, knob 40 is movable within a range of angular positions, e.g., about 270 degrees from an off position (designated as the 0 degree position). Also in this implementation, user control 28 is mechanically coupled to a gas valve to regulate gas flow through the gas valve to supply a controlled flow of gas to a gas cooktop burner, and subrange 42 is used to illustrate the gas flow subrange of positions of knob 40 at which gas is permitted to flow through the gas valve, generally starting at about 25 degrees from the off position, increasing to a maximum flow rate at about 90 degrees from the off position, and steadily decreasing to a minimum flow rate that can sustain a flame at about 270 degrees from the off position. An ignitor (not shown in FIG. 2) may be used to ignite gas emitted from the gas burner, and is generally controlled by a position-sensitive ignition switch (also not shown in FIG. 2) that is active when the knob 40 is in an ignition subrange of positions 44, which is generally configured to activate slightly prior to the initiation of gas flow (e.g., about 20 degrees from the off position) and deactivate slightly prior to reaching the maximum flow rate for the gas valve (e.g., about 80 degrees from the off position).

A self-closing user control consistent with the invention may be configured to incorporate a biased subrange of positions and an unbiased subrange of positions, with the former configured to bias the self-closing user control to the off position such that when the control actuator of the self-closing user control is released when in this subrange of positions, the control actuator may automatically return to the off position and thereby deactivate the cooking element. The latter is configured to allow the control actuator of the self-closing user control to maintain its position when released, such that the user may set an output level of the associated cooking element and otherwise operate the cooking element in a normal manner.

In the embodiment of FIG. 2, for example, biased and unbiased subranges of positions are represented at 46 and 48. The biased subrange of positions 46, for example, may be configured to at least partially, and in some instances completely, overlap the ignition subrange of positions 44, while the unbiased subrange of positions 46 may be configured to at least partially, and in some instances, completely, overlap an operating subrange of positions (e.g., the subrange of positions extending from the maximum (about 90 degrees) to the minimum (about 270 degrees) positions for the cooking element. It will also be appreciated that in this embodiment the ignition subrange of positions 44 is intermediate the unbiased subrange of positions 48 and the off position.

In addition, while in some embodiments the biased and unbiased subranges of positions 46, 48 may be adjacent one another, in the embodiment of FIG. 2, a third subrange of positions, referred to herein as a transition subrange of positions 50, may be interposed between subranges 46, 48. representing the region in which the mechanical arrangement that controls whether the self-closing user control is biased to the off position transitions from a biased state to an unbiased state. In the embodiment of FIG. 2, for example, the biased subrange of angular positions 46 may end at about 80 degrees, proximate where the ignitor is deactivated, while the unbiased subrange of angular positions 48 begins about 90 degrees from the off position, proximate where the operating subrange of positions for the cooking element begins.

As such, when a user is intentionally attempting to energize a cooking element, the user may move the self-closing user control completely through the biased subrange of positions and into the unbiased subrange of positions, the self-closing user control will generally maintain its current setting upon being released, thereby enabling the user to, for example, set the output level of the cooking element by adjusting the position of the user control within the unbiased subrange of positions. In contrast, the likelihood of an unintended energization of a cooking element is minimized, such that if the self-closing user control is bumped into by a user, child or pet and only moved into the biased subrange of positions from the off position, the self-closing user control will return automatically to the off position. In addition, it will be appreciated that a self-closing user control consistent with the invention may also be configured to operate using a two-step activation sequence (e.g., requiring a knob to be pushed in prior to turning) to further reduce the likelihood of unintentional energization of a cooking element.

Figure 3:
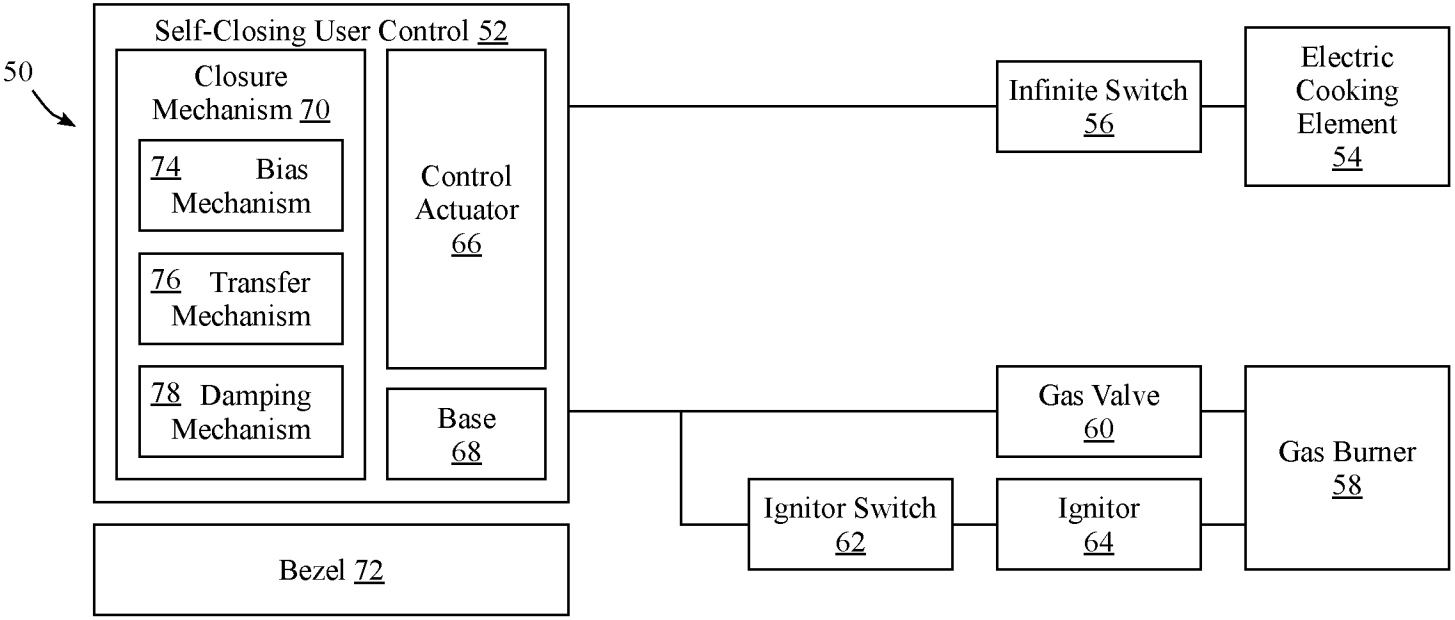
FIG. 3 is a block diagram of another cooking appliance including a self-closing user control consistent with some embodiments of the invention.

FIG. 3 next illustrates an example cooking appliance 50 incorporating a self-closing user control 52 capable of operating various types of cooking elements, and incorporating various types of mechanisms suitable for implementing the herein-described techniques in various embodiments. In some instances, for example, user control 52 may be used to both activate/deactivate and regulate an output level of an electrically-powered cooking element 54 such as a resistive or inductive heating element, a light element, a microwave element, etc. Where the cooking element 54 is a resistive heating element, for example, user control 52 may be mechanically coupled to an infinite switch 56 to both activate and regulate the output level of the cooking element 54. Other electrically-powered cooking elements may be controlled in different manners, e.g., using an encoder, a potentiometer, etc., and it will be appreciated that the use of a self-closing user control with such control devices would be well understood by those of ordinary skill having the benefit of the instant disclosure. Alternately, user control 52 may be used to control a gas-powered cooking element, e.g., a gas burner 58, and may be mechanically coupled to a gas valve 60, as well as to an ignitor switch 62 that controls an ignitor 64 positioned adjacent gas burner 58. For other types of cooking elements, self-closing user control 52 may be integrated with other control devices as will be understood by those of ordinary skill having the benefit of the instant disclosure.

User control 52 generally includes a movable control actuator 66 coupled to a fixed base 68, as well as a closure mechanism 70 that provides the self-closing functionality capable of automatically returning the control actuator 66 to the off position when released in a biased subrange of positions. Control actuator 66 may take various forms, e.g., a rotary control actuator such as a knob or wheel, a linear control actuator such as a lever or slider, etc., and it will be appreciated that the various components of closure mechanism 70 may be incorporated into control actuator 66 and/or base 68 in different embodiments. Indeed, one or more components of closure mechanism 70 may be implemented within various other components in a cooking appliance in some embodiments, e.g., a switch (e.g., infinite switch 56 or ignitor switch 62), gas valve 60, a bezel 72, a housing, etc.

Closure mechanism 70 generally biases control actuator 66 of self-closing user control 52 to the off angular position when the control actuator of the self-closing user control is in a biased subrange of angular positions, but not when the control actuator is in an unbiased subrange of angular positions. As such, in some embodiments closure mechanism 70 may include a bias mechanism 74, e.g., a spring, a magnet, etc., that is capable of biasing the control actuator to the off position, coupled with a transfer mechanism that is capable of transferring a load of the bias mechanism between the control actuator 66 and a fixed portion of the self-closing user control 52 (e.g., base 68).

In addition, in some embodiments it may also be desirable to incorporate a damping mechanism 78, e.g., a pneumatic or hydraulic dashpot, a cushion, etc., in order to dampen return of the self-closing user control to the off position, e.g., to inhibit the control actuator or another component of the self-closing user control from rapidly springing back to the off position, which might otherwise generate undesirable noises and/or lead to increased wear. In other embodiments, however, a damping mechanism may be omitted.

Figure 4:
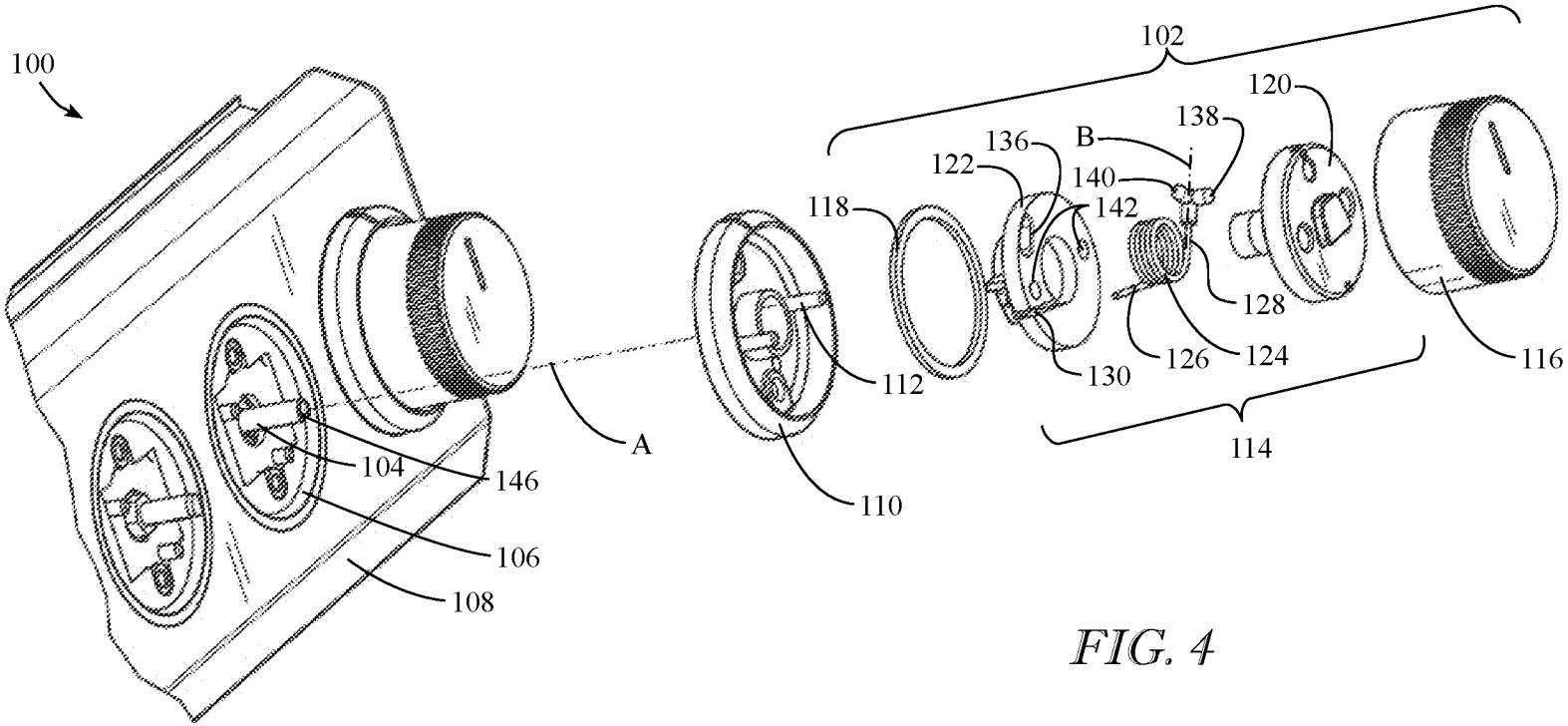
FIG. 4 is a partially-exploded front perspective view of a portion of another cooking appliance, and including a self-closing user control consistent with some embodiments of the invention.
Figure 5:
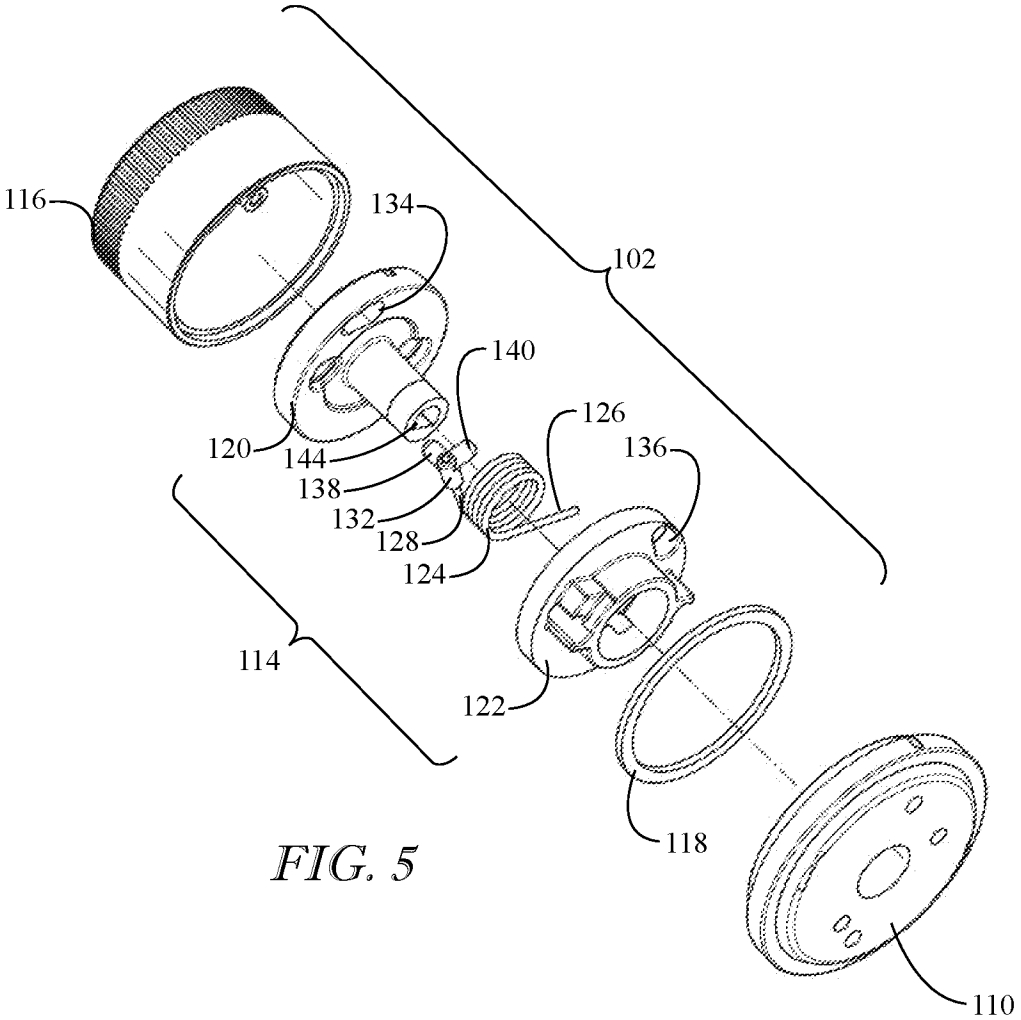
FIG. 5 is an exploded rear perspective view of the self-closing user control of FIG. 4.

Now turning to FIGS. 4-5, a cooking appliance 100 is illustrated with a self-closing user control 102 consistent with some embodiments of the invention. User control 102 is configured for use in controlling a gas burner through a mechanical coupling to a gas valve 104 that projects through an opening 106 in a housing 108 of the cooking appliance 100 and rotates about an axis of rotation A.

Self-closing user control 102 in this embodiment is a self-contained unit that is received in a bezel 110 having a pair of posts 112 that anchor a fixed portion of the user control. A closure mechanism 114 is disposed intermediate a rotary control actuator or knob 116 and a retaining ring 118 and includes a rotatable closure member 120 that is rotatable about axis of rotation A with knob 116, a fixed closure member 122 that is non-rotatable about axis of rotation A, and a bias mechanism, here a torsion spring 124, disposed therebetween and configured to be loaded in response to rotation of knob 116 away from the off position.

Torsion spring 124 includes first and second legs 126, 128, with leg 126 being received in a recess 130 of fixed closure member 122. The second leg 128 includes a transfer mechanism, here a pin 132, that is rotatable about an axis rotation B defined by second leg 128, and that as will be described in greater detail below, selectively engages one of a pair of pin recesses 134, 136 defined in rotatable and fixed closure members 120, 122 to transfer the load of spring 124 to either of rotatable and fixed closure members 120, 122 depending upon whether knob 116 is in the biased or unbiased subrange of positions. Each pin recess 134, 136 may extend completely through its respective closure member, or may simply extend through only a portion of the thickness of the closure member, and in some embodiments, each pin recess 134, 136 may be teardrop shaped to facilitate engagement with pin 132.

Pin 132 includes a pair of radial members 138, 140 that extend generally radially from axis of rotation B and are angularly offset from one another about axis of rotation B. In some embodiments, the radial members 138, 140 extend generally perpendicularly from axis of rotation B and are about 90 degrees offset from one another, although the invention is not so limited. Radial member 138 is configured to engage pin recess 134 of rotatable closure member 120 when the self-closing user control is in the biased subrange of angular positions, and radial member 140 is configured to engage pin recess 136 of fixed closure member 122 when the self-closing user control is in the unbiased subrange of angular positions. Furthermore, pin 132 is configured to rotate about axis of rotation B to disengage radial member 138 from pin recess 134 and engage radial member 140 with pin recess 136 when the self-closing user control transitions from the biased subrange of angular positions to the unbiased subrange of angular positions, as will be described in greater detail below.

For installation, fixed closure member 122 includes a pair of apertures 142 that receive posts 112 of bezel 110, while rotatable closure member 120, which is fixed to knob 116, includes a keyed aperture 144 that receives a valve stem 146 of gas valve 104.

Figure 6A:
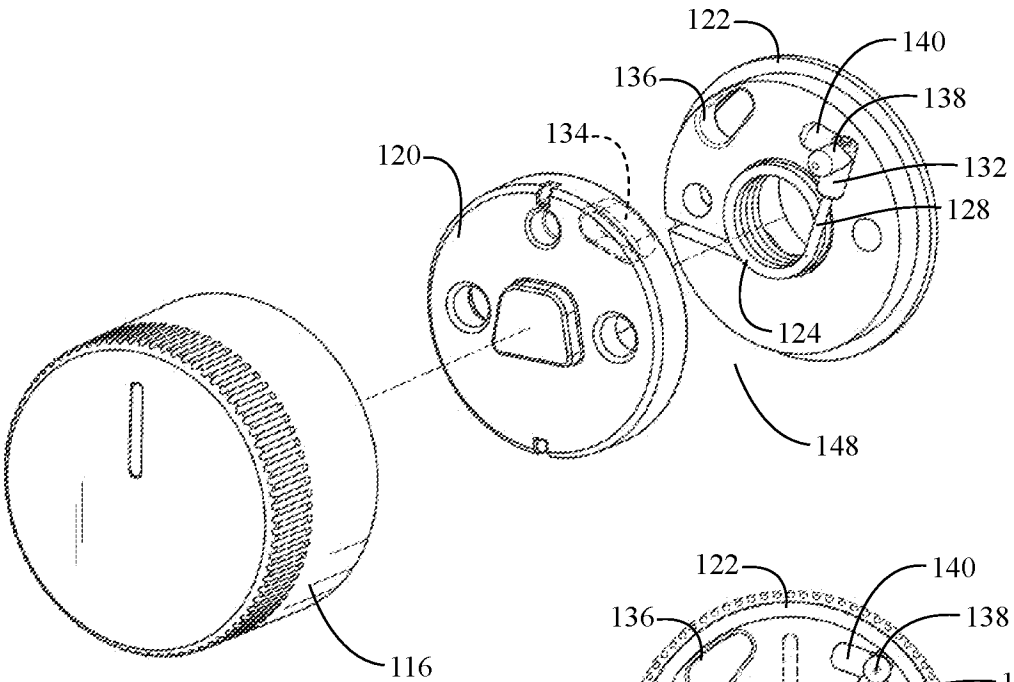
FIG. 6A is an exploded front perspective view of the self-closing user control of FIG. 4, and disposed in an off position.
Figure 6B:
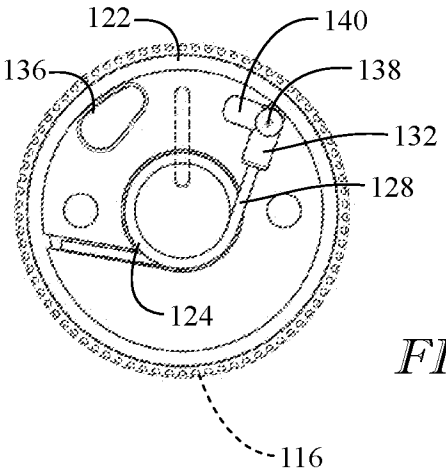
FIG. 6B is a front perspective view of the self-closing user control of FIG. 6A, with the knob and rotating member thereof shown in phantom.

Now turning to FIGS. 6A-10B, the operation of self-closing user control 102 is illustrated in greater detail. FIGS. 6A-6B illustrated user control 102 in an off position (about 0 degrees). It may be seen that in this position, pin 132 is rotated about leg 128 of spring 124 to position radial member 138 within pin recess 134 of rotatable closure member 120, while radial member 140 is separated from pin recess 136 of fixed closure member 122, and positioned within an annular track 148 defined between rotatable and fixed closure members 120, 122. It will therefore be appreciated that the load of spring 124, to the extent that the spring is preloaded, is borne by rotatable closure member 120 due to the engagement of radial member 138 within pin recess 134, such that any rotation of the knob in a counter-clockwise direction from the off position will be opposed by the bias of the spring.

Figure 7B:
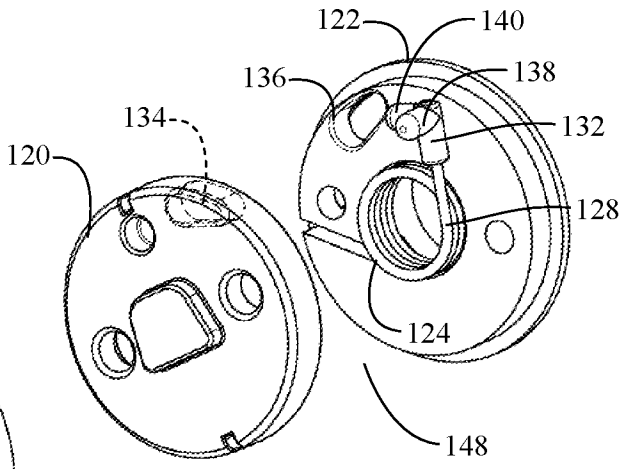
Figure 7B:
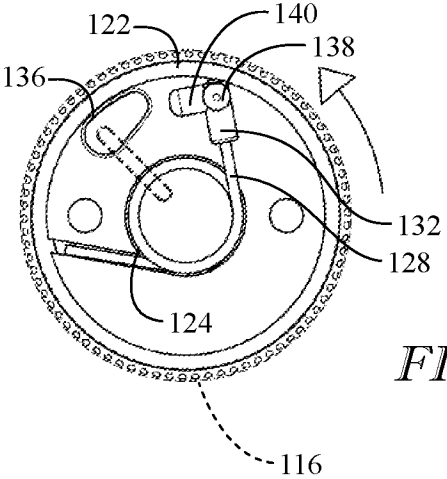
Figure 7A:
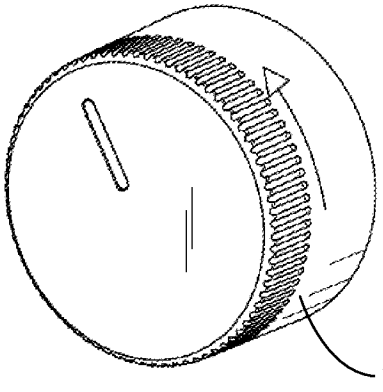

As illustrated in FIGS. 7A and 7B, rotation of knob 116 in a counter-clockwise direction to about 27.5 degrees from the off position causes pin recess 134 to travel in a counter-clockwise manner, and due to the engagement of radial member 138 of pin 132, leg 128 of spring 124 is increasingly loaded. Due to the orientation of pin 132, however, radial member 140 projects within track 148 and thus does not engage fixed closure member 122, but rather moves relative to the fixed closure member 122, and with rotatable closure member 120. It will be appreciated that due to the torque imparted on pin 132 by the engagement of radial member 138 with pin recess 134, radial member 140 generally rides along a facing surface of fixed closure member 122.

Figure 8B:
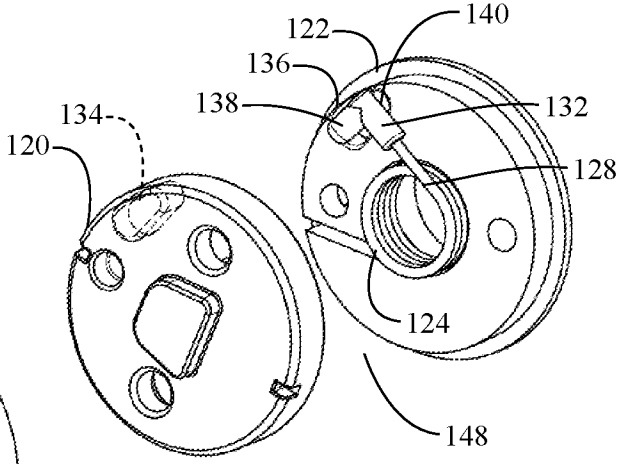
Figure 8B:
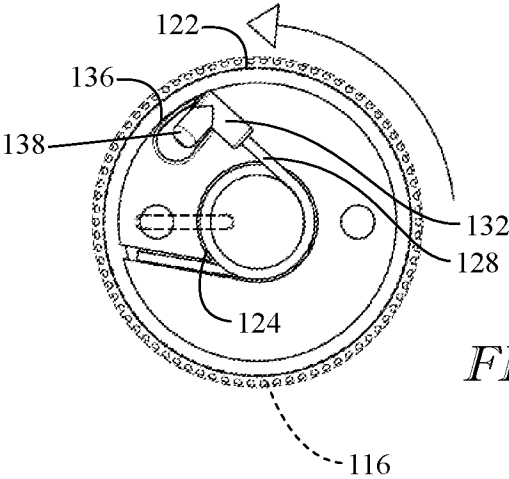
Figure 8A:
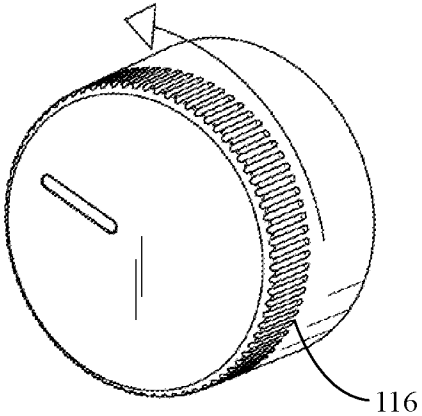

Next, as illustrated in FIGS. 8A and 8B, rotation of knob 116 further in the counter-clockwise direction to about 45 degrees from the off position causes pin recess 134 to travel further in the clockwise manner, and due to the engagement of radial member 138 of pin 132, leg 128 of spring 124 is further loaded. However, at this point radial member 140 has moved partially opposite pin recess 136 of fixed closure member 122 and the torque imparted on pin 132 by the engagement of radial member 138 with pin recess 134 will begin to urge pin 132 to rotate about leg 128 to turn radial member 140 into pin recess 136 of fixed closure member 122. Concurrently, the rotation of pin 132 also begins to withdraw radial member 138 from pin recess 134 of rotatable closure member 120. It will be appreciated that, up to this point, the load of spring 124 is on rotatable closure member 120, such that, if released, the knob will automatically return to the off position.

Figure 9B:
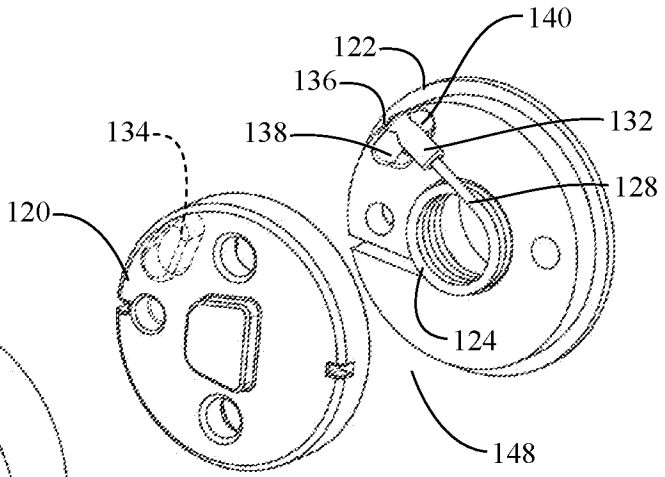
Figure 9B:
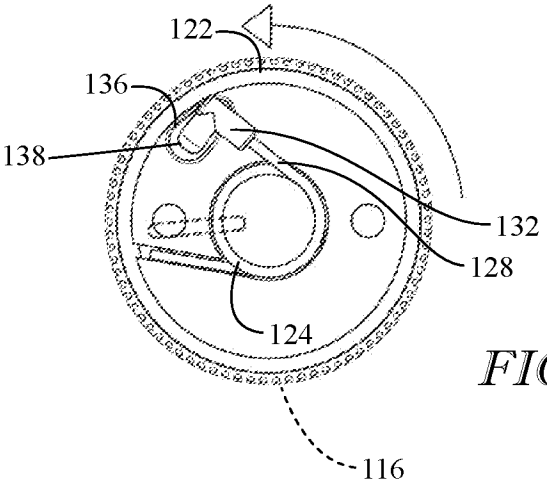
Figure 9A:
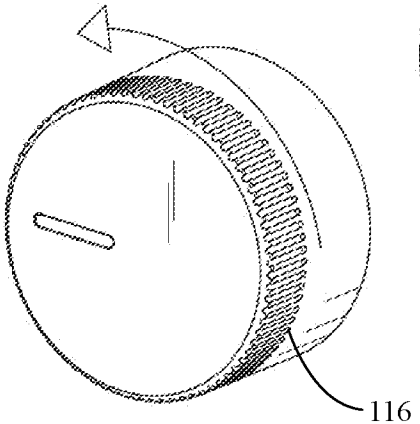
Figure 10A:
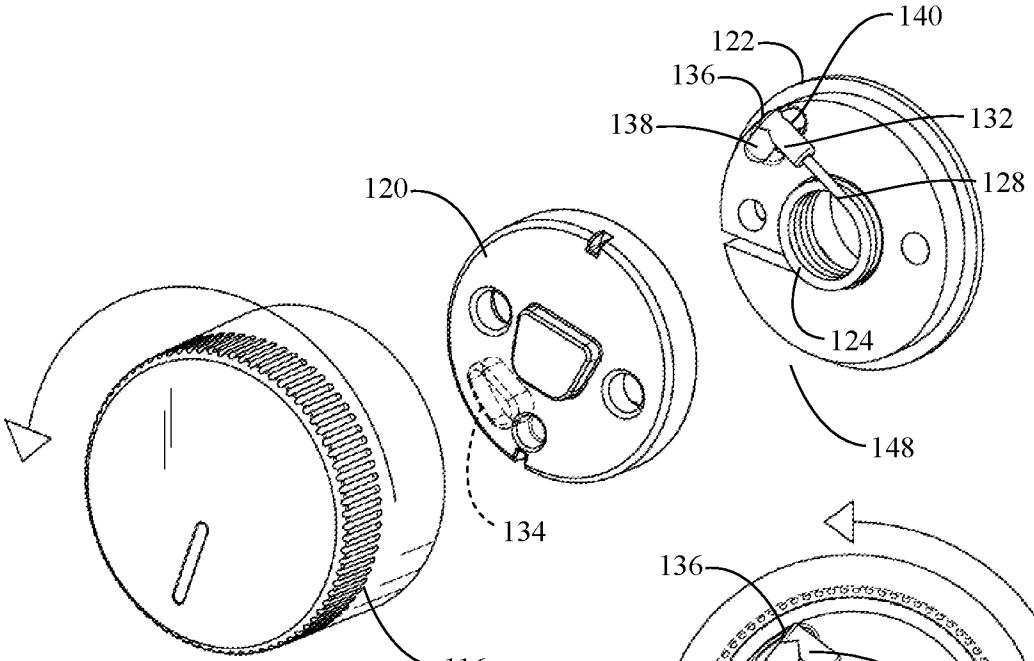
Figure 10B:
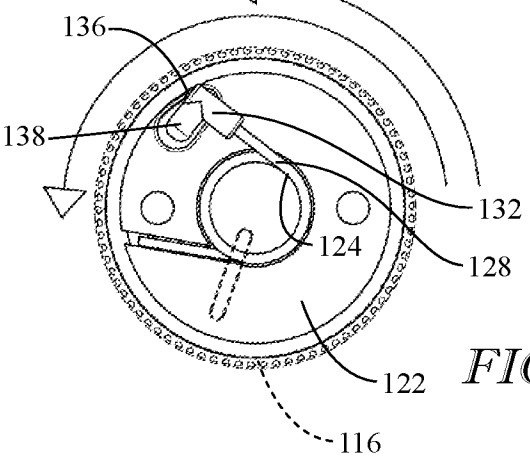

Next, as illustrated in FIGS. 9A and 9B, the continued rotation of knob 116 further in the counter-clockwise direction, and a further rotation of pin 132 about leg 128 is illustrated, whereby radial member 140 has moved into pin recess 136 of fixed closure member 122 and radial member 138 has been withdrawn from pin recess 134 of rotatable closure member 120, thereby effectively transferring the load of spring 124 to fixed closure member 122. Thus, as illustrated in FIGS. 10A and 10B, further rotation of knob 116 in the counter-clockwise direction causes pin recess 134 to separate from radial member 138, such that radial member 138 is positioned within track 148 and slides along a facing surface of rotatable closure member 120, and notably, pin 132 is incapable of rotating about leg 128 to reengage radial member 138 with pin recess 134. As such, beyond the position illustrated in FIGS. 10A-10B, which is about 80 degrees from the off position, the load of spring 124 is transferred to fixed closure member 122, and knob 116 is free to rotate without the bias of spring 124, such that, if released, the knob will remain in position. When knob 116 is turned back in a clockwise direction beyond the position illustrated in FIGS. 10A-10B, however, the torque on pin 132 will urge radial member 138 back into pin recess 134, thereby transferring the load of the spring back onto rotatable closure member 120, such that, if released, the knob will automatically return to the off position.

Figure 11:
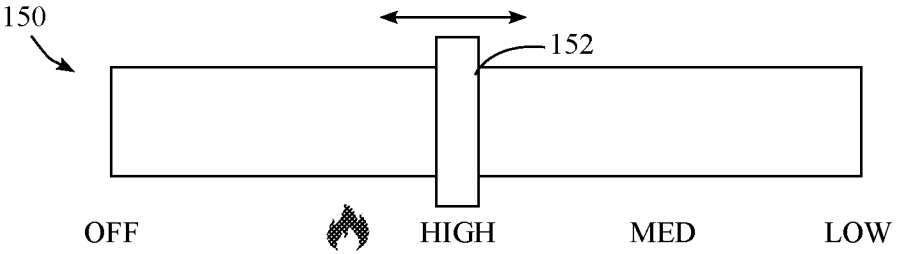
FIG. 11 is a front perspective view of a linear slider self-closing user control consistent with some embodiments of the invention.
Figure 12:
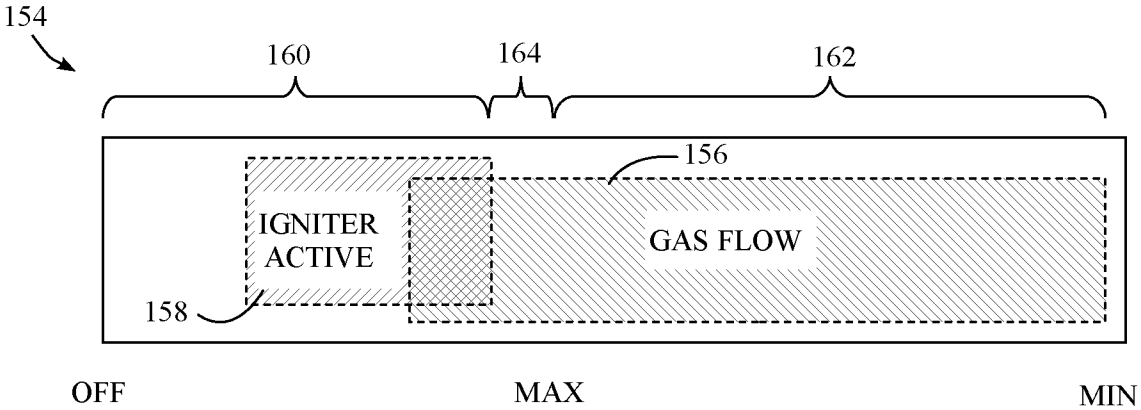
FIG. 12 is a diagram illustrating various positional subranges in the movement of the self-closing user control referenced in FIG. 11.

Various alternative designs may be used to implement a self-closing user control in other embodiments. FIG. 11, for example, illustrates a self-closing user control 150 for a gas burner implemented as a linear slider having a linear control actuator 152 movable between an off position to an ignition position and then through an operating range between high, medium and low output power levels. As illustrated in FIG. 12, an operating range 154 of user control 150 may include a gas flow subrange 156 that overlaps with an ignition subrange 158. Biased and unbiased subranges 160, 162 may also be defined, with an optional transition subrange 164 defined therebetween. User control 150 may thus be configured such that the linear control actuator 152 is normally biased to the off position and, as the linear control actuator is moved to the right (either intentionally or unintentionally) but released within the biased subrange 160, the linear control actuator will return automatically to the off position. If, however, the linear control actuator is moved beyond the biased subrange 160 and into the unbiased subrange 162, the linear control actuator will remain in place. It should also be appreciated that, as the biased subrange 160 overlaps the ignition subrange 158, ignition of the gas burner requires that a user hold the linear control actuator within the ignition subrange, and any release of the linear control actuator during this time will automatically return the linear control actuator to the off position.

Figure 13A:
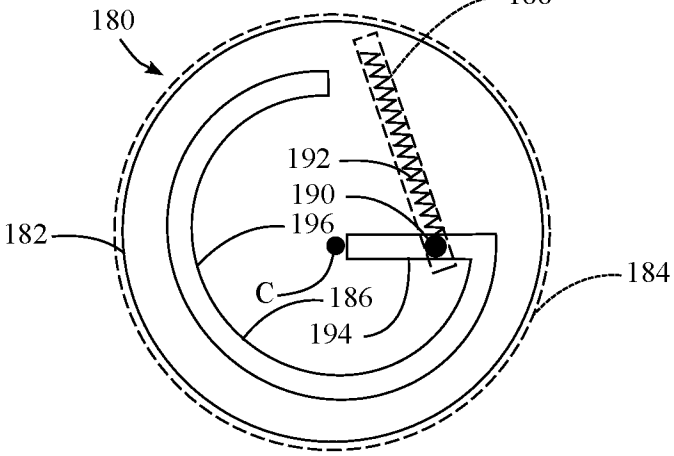
FIGS. 13A-13B illustrate another example embodiment of a self-closing user control consistent with some embodiments of the invention, with the self-closing user control being positioned respectively within a biased subrange of positions (FIG. 13A) and an unbiased subrange of positions (FIG. 13B).
Figure 13B:
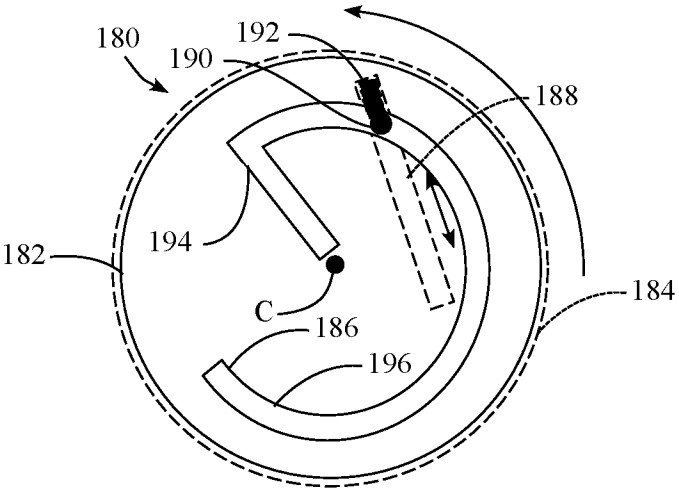

FIGS. 13A-13B next illustrate another embodiment of a self-closing user control that utilizes a spring-loaded cam follower that is movable in opposing tracks of rotatable and fixed closure members to provide biased and unbiased subranges of positions in a manner consistent with the invention. Specifically, FIG. 13A illustrates a self-closing user control 180 including opposing rotatable and fixed closure members 182, 184, the former of which is rotatable about an axis of rotation C and mechanically coupled to a knob (not shown in FIGS. 13A-13B) for rotation therewith, and the latter of which being non-rotatable about the axis of rotation. Closure members 182, 184 include respective tracks 186, 188 that face one another, with a spring-loaded cam follower 190 disposed therebetween to engage with both tracks 186, 188 and constrain movement of rotatable closure member 182 relative to fixed closure member 184. Spring-loaded cam follower 190 is biased by a spring 192 for movement along track 188, and track 186 is generally "G"-shaped and includes a substantially radial portion 194 that extends generally radially from axis of rotation C and a substantially annular portion 196 that extends generally peripherally about axis of rotation C. Substantially radial portion 194 effectively defines a biased subrange of positions for user control 180, while substantially annular portion 196 effectively defines an unbiased subrange of positions for user control 180.

FIG. 13A in particular illustrates user control 180 in an off-position, and it may be seen that cam follower 190 is disposed in substantially radial portion 194 of track 186. Counter-clockwise movement of rotatable closure member 182 away from the off position is opposed by spring 192 when the self-closing user control is in the biased subrange of angular positions, such that if the knob is released while cam follower 190 is within substantially radial portion 194 of track 186, the spring 192 will urge the user control back to the off position. However, as shown in FIG. 13B, if the rotatable closure member 182 is rotated further to a position where cam follower 190 is disposed in substantially annular portion 196 of track 186, spring 192 will be loaded but the load is borne by fixed closure member 184, and rotatable closure member 182 is then in an unbiased subrange of positions.

Figure 14A:
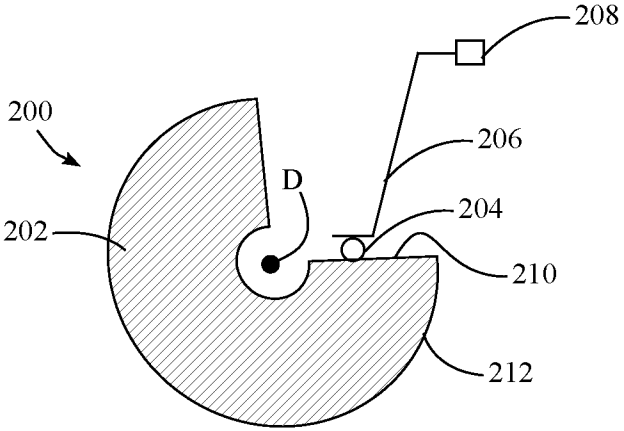
FIGS. 14A-14B illustrate yet another example embodiment of a self-closing user control consistent with some embodiments of the invention, with the self-closing user control being positioned respectively within a biased subrange of positions (FIG. 14A) and an unbiased subrange of positions (FIG. 14B).
Figure 14B:
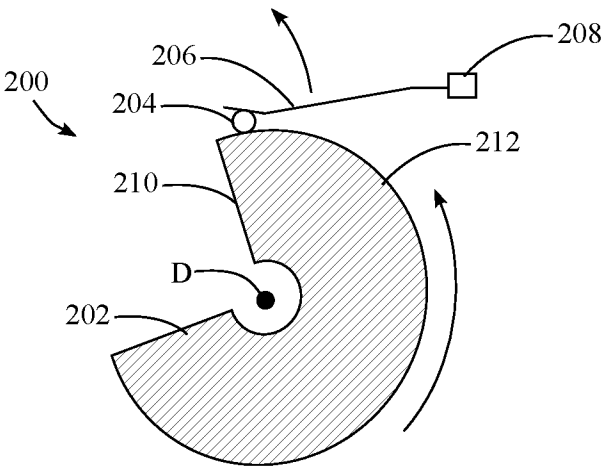

FIGS. 14A-14B next illustrate yet another embodiment of a self-closing user control that utilizes a spring-loaded cam follower that engages a cam that rotates with a knob, and with the cam specifically configured to define biased and unbiased subranges of positions in a manner consistent with the invention. Specifically, FIG. 14A illustrates a self-closing user control 200 including a cam 202, e.g., configured as a disk-shaped body, which is rotatable about an axis of rotation D and mechanically coupled to a knob (not shown in FIGS. 14A-14B) for rotation therewith. A spring-loaded cam follower 204 is biased by a spring 206 (e.g., a beam or leaf spring, a torsion spring, a compression spring, etc.), which is anchored to a non-rotatable structure 208 such that the end of spring 206 opposite cam follower 204 is disposed in a substantially fixed position. Cam 202 includes a substantially radial portion 210 that extends generally radially from axis of rotation D and a substantially annular portion 212 that extends generally peripherally about axis of rotation D. Substantially radial portion 210 effectively defines a biased subrange of positions for user control 200, while substantially annular portion 212 effectively defines an unbiased subrange of positions for user control 200.

FIG. 14A in particular illustrates user control 200 in an off-position, and it may be seen that cam follower 204 is engaging in substantially radial portion 210 of cam 202. Counter-clockwise movement away from the off position is opposed by spring 206 when the self-closing user control is in the biased subrange of angular positions, such that if the knob is released while cam follower 204 is engaging substantially radial portion 210 of cam 202, the spring 206 will urge the user control back to the off position. However, as shown in FIG. 14B, further rotation occurs to a position where cam follower 204 engages substantially annular portion 212 of cam 202, spring 206 will not be able to impart a torque on the cam, and the user control is then in an unbiased subrange of positions.

Figure 15:
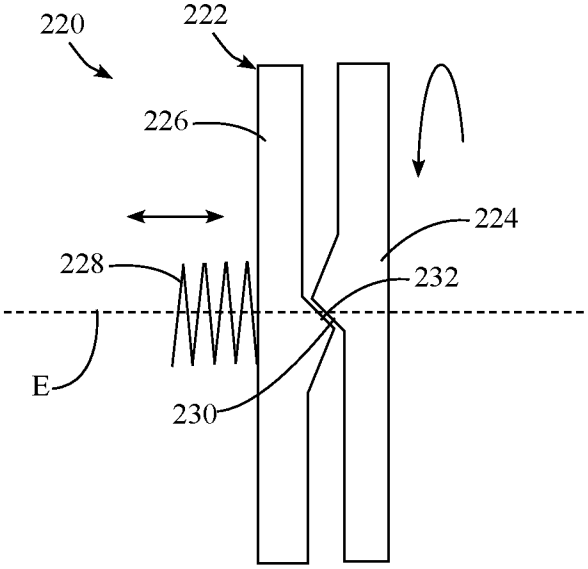
FIG. 15 illustrates another example embodiment of a self-closing user control consistent with some embodiments, and utilizing an axial clutch assembly.

FIG. 15 illustrates yet another self-closing user control 220, including a closure mechanism 222 configured as a clutch assembly including first and second opposing clutch members 224, 226 configured for relative rotation therebetween about an axis of rotation E. Clutch member 224, for example, may be configured for rotation about axis of rotation E and mechanically coupled to a knob (not shown in FIG. 15) for rotation therewith. Clutch member 226 may be biased, e.g., by a spring 228, for movement along axis of rotation E, such that opposing faces of clutch members 224, 226 are pressed into contact with one another. Clutch member 226 may be fixed against rotation about axis of rotation E in some embodiments, or may also be configured to rotate somewhat, and may also include a spring or other bias against rotation such that the clutch member 226 automatically returns to an off position in the absence of urging from clutch member 224. Each clutch member 224, 226 also may include an associated engagement surface 230, 232, with surfaces 230, 232 configured along with the bias applied by spring 228 and/or any bias against rotation of clutch member 226 to cause clutch members 224, 226 to rotate together in response to turning of the knob in a counter-clockwise direction from an off position, but then separate proximate a position where it is desirable to transition from a biased configuration to an unbiased configuration, causing clutch member 226 to return to the off position and clutch member 224 to rotate free of any bias towards the off position. It will be appreciated that the configuration of surfaces 230, 232 along with the configuration of the various biases applied in the clutch assembly in order to cause the clutch assembly to perform such a transition proximate a desired angular position (thereby transitioning from a biased subrange of positions to an unbiased subrange of positions) would be well within the abilities of those of ordinary skill having the benefit of the instant disclosure.

Figure 16:
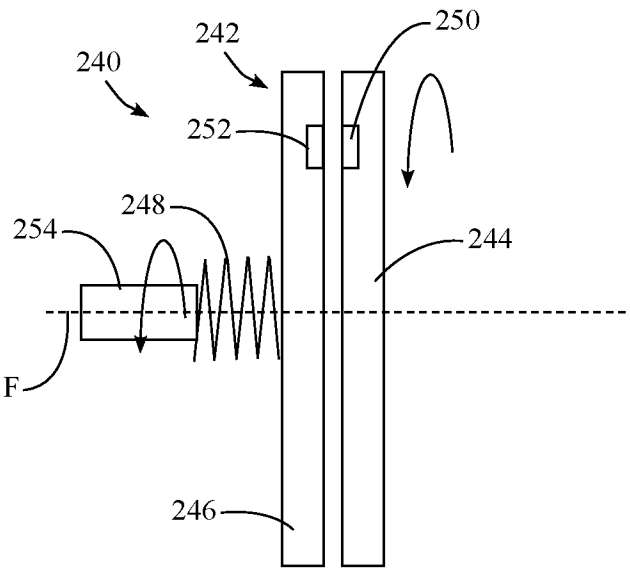
FIG. 16 illustrates yet another example embodiment of a self-closing user control consistent with some embodiments, and utilizing a magnetic clutch assembly.

FIG. 16 illustrates various alternative techniques that may be employed in other clutch assembly designs. In particular, FIG. 16 illustrates another self-closing user control 240, including a closure mechanism 242 configured as a clutch assembly including first and second opposing clutch members 244, 246 configured for relative rotation therebetween about an axis of rotation F. Clutch member 244 may be configured for rotation about axis of rotation F and mechanically coupled to a knob (not shown in FIG. 16) for rotation therewith. Clutch member 246 may be biased, e.g., by a spring 248, against rotation about axis of rotation F, but unlike closure mechanism 222 of FIG. 15, may not be movable along the axis of rotation. In addition, rather than using engagement surfaces, closure mechanism 240 may include a pair of magnets 250, 252 embedded in clutch members 244, 246 and opposing one another when the clutch assembly is in an off position. Magnets 250, 252 may be configured along with the bias applied by spring 248 to cause clutch members 244, 246 to rotate together in response to turning of the knob in a counter-clockwise direction from an off position, but then separate proximate a position where it is desirable to transition from a biased configuration to an unbiased configuration, causing clutch member 246 to return to the off position and clutch member 244 to rotate free of any bias towards the off position. It will be appreciated that the configuration of magnets 250, 252 and spring 248 in order to cause the clutch assembly to perform such a transition proximate a desired angular position (thereby transitioning from a biased subrange of positions to an unbiased subrange of positions) would be well within the abilities of those of ordinary skill having the benefit of the instant disclosure.

In addition, closure mechanism 242 additionally includes a damping mechanism 254, e.g., a viscous dashpot, that operates as a "soft close" device such that when the knob is released in the biased subrange of positions, or when the clutch members 244, 246 separates during a transition to the unbiased subrange of positions, clutch member 246 will return to the off position in a relatively controlled and quiet manner.

Various modifications may be made to the illustrated embodiments without departing from the spirit and scope of the invention. It will be appreciated, for example, that while certain structures are disclosed as being disposed in a rotatable or fixed closure member, in many instances the positioning of such structures may be reversed, such that a component that is illustrated as part of a rotatable closure member may be instead incorporated into a fixed closure member, and vice versa. Moreover, such components may, in other embodiments, be incorporated into other structures, including other parts of a self-closing user control and/or other surrounding structures on the housing of the cooking appliance. It will also be appreciated that the contours and shapes of the various tracks and cam surfaces disclosed herein may be varied in different embodiments to control the positions and/or sizes of the biased and unbiased subranges and positions, the transitions therebetween, and/or the amount of closing force applied by the user control.

Other modifications may be made to the embodiments discussed herein, and a number of the concepts disclosed herein may be used in combination with one another or may be used separately. Therefore, the invention lies in the claims hereinafter appended.

What is claimed is:

1. A cooking appliance, comprising:

a cooking element; and a self-closing user control configured to activate the cooking element and control an output level of the cooking element, wherein the self-closing user control includes a knob and is rotatable by a user within a range of angular positions about an axis of rotation, wherein the range of angular positions includes an off angular position at which the cooking element is inactive, a biased subrange of angular positions within which the self-closing user control is biased to the off position such that the self-closing user control automatically returns to the off angular position when released by the user, and an unbiased subrange of angular positions within which the self-closing user control is unbiased such that the self-closing user control maintains its angular position when released by the user, and wherein the biased subrange of angular positions extends at least about 20 degrees from the off angular position.

2. The cooking appliance of claim 1, wherein the cooking element is active when the control actuator is in at least a portion of the biased subrange of angular positions such that the cooking element is automatically deactivated when the control actuator is released by the user within the at least a portion of the biased subrange of angular positions.

3. The cooking appliance of claim 1, wherein the cooking element is a gas burner, the cooking appliance includes a gas valve configured to regulate gas flow to the gas burner, and the self-closing user control is mechanically coupled to the gas valve.

4. The cooking appliance of claim 3, wherein the cooking appliance further includes an igniter configured to ignite the gas burner when gas flow is supplied to the gas burner by the gas valve and the self-closing user control is in an ignition subrange of angular positions.

5. The cooking appliance of claim 4, wherein the biased subrange of angular positions at least partially overlaps the ignition subrange of angular positions.

6. The cooking appliance of claim 4, wherein the ignition subrange of angular positions is intermediate the off angular position and the unbiased subrange of angular positions.

7. The cooking appliance of claim 4, wherein the unbiased subrange of angular positions at least partially overlaps an operating subrange of angular positions.

8. The cooking appliance of claim 1, wherein the biased subrange of angular positions extends at least about 80 degrees from the off angular position and the unbiased subrange of angular positions extends at least from about 90 degrees from the off angular position.

9. The cooking appliance of claim 1, further comprising a closure mechanism that biases the self-closing user control to the off angular position when the self-closing user control is in the biased subrange of angular positions.

10. The cooking appliance of claim 1, wherein the self-closing user control further includes a damping mechanism configured to dampen return of the self-closing user control to the off angular position when released by the user.

11. A cooking appliance, comprising:

a cooking element, wherein the cooking element is an electric, inductive, light, or microwave cooking element; and a self-closing user control configured to activate the cooking element and control an output level of the cooking element, wherein the self-closing user control is movable by a user within a range of positions, wherein the range of positions includes an off position at which the cooking element is inactive, a biased subrange of positions within which the self-closing user control is biased to the off position such that the self-closing user control automatically returns to the off position when released by the user, and an unbiased subrange of positions within which the self-closing user control is unbiased such that the self-closing user control maintains its position when released by the user.

12. The cooking appliance of claim 11, wherein the cooking element is active when the control actuator is in at least a portion of the biased subrange of positions such that the cooking element is automatically deactivated when the control actuator is released by the user within the at least a portion of the biased subrange of positions.

13. The cooking appliance of claim 11, wherein the unbiased subrange of positions at least partially overlaps an operating subrange of positions.

14. The cooking appliance of claim 11, wherein the self-closing user control includes a knob that rotates about an axis of rotation, the range of positions corresponds to a range of angular positions about the axis of rotation, the biased subrange of positions corresponds to a biased subrange of angular positions about the axis of rotation and the unbiased subrange of positions corresponds to an unbiased subrange of angular positions about the axis of rotation.

15. The cooking appliance of claim 14, wherein the biased subrange of angular positions extends at least about 20 degrees from an off angular position corresponding to the off position.

16. The cooking appliance of claim 14, wherein the biased subrange of angular positions extends at least about 80 degrees from an off angular position corresponding to the off position and the unbiased subrange of angular positions extends at least from about 90 degrees from the off angular position.

17. The cooking appliance of claim 14, further comprising a closure mechanism that biases the self-closing user control to the off angular position when the self-closing user control is in the biased subrange of angular positions.

18. The cooking appliance of claim 11, wherein the self-closing user control further includes a damping mechanism configured to dampen return of the self-closing user control to the off position when released by the user.

* * * * *